US005797357A

United States Patent [19]

Kawachi et al.

[11] Patent Number: 5,797,357

[45] Date of Patent: Aug. 25, 1998

[54] APPARATUS FOR FORMING PROTECTIVE FILMS IN WATER FEED PIPES OF BOILER

[75] Inventors: Atsushi Kawachi, Kani; Norifumi Matsuda, Inuyama; Akiyoshi Hayashi, Gifu, all of Japan

[73] Assignee: Energy Support Corporation, Japan

[21] Appl. No.: 545,972

[22] Filed: Oct. 20, 1995

[30] Foreign Application Priority Data

| | | | |
|---|---|---|---|
| Oct. 21, 1994 | [JP] | Japan | 6-257121 |
| Dec. 22, 1994 | [JP] | Japan | 6-320660 |
| Dec. 27, 1994 | [JP] | Japan | 6-326129 |
| May 22, 1995 | [JP] | Japan | 7-122599 |
| May 12, 1995 | [JP] | Japan | 7-144787 |

[51] Int. Cl.[6] ..... F22B 37/48

[52] U.S. Cl. ..... 122/398; 122/DIG. 7; 148/287

[58] Field of Search ..... 122/5, 51, 398, 122/401, DIG. 7; 148/287

[56] References Cited

FOREIGN PATENT DOCUMENTS

| | | | |
|---|---|---|---|
| A 181 192 | 5/1986 | European Pat. Off. | C23C 8/18 |
| 52-126641 | 10/1977 | Japan . | |
| 53-47062 | 12/1978 | Japan . | |
| 60-103172 | 6/1985 | Japan | C23C 8/10 |
| 60-116760 | 6/1985 | Japan | C23C 8/12 |
| 62-218548 | 9/1987 | Japan . | |
| 62-245007 | 10/1987 | Japan . | |
| 62-248903 | 10/1987 | Japan . | |
| 02 157503 | 6/1990 | Japan | F22D 11/00 |
| 2-157503 | 6/1990 | Japan . | |
| 6-58437 | 8/1994 | Japan . | |
| 6-257710 | 9/1994 | Japan . | |

*Primary Examiner*—Noah P. Kamen
*Attorney, Agent, or Firm*—Limbach & Limbach L.L.P.

[57] ABSTRACT

An apparatus includes a boiler for receiving water from a water feed pipe and heating the water into steam and a condenser for condensing the steam into condensate. The condensate is fed back to the boiler through the water feed pipe. A solute source includes a solute which has at least one of oxygen, hydrogen peroxide and ozone. Generating member generates an aqueous solution by dissolving the solute supplied from the solute source into water. Supplying member supplies the aqueous solution to the water feed pipe to form a protective film made of iron oxide on an inner surface of the water feed pipe.

11 Claims, 6 Drawing Sheets

Fig.2

| | | Oxygen bomb | PSA method |
|---|---|---|---|
| Oxygen | | 99.9% | 95.0% |
| Argon | | ≦1000ppm | 4.6% |
| Nitrogen | | ≦10ppm | 0.4% |
| Corrosive gas | Carbon monoxide | ≦10ppm | ≦1ppm |
| | Carbon dioxide | ≦10ppm | ≦1ppm |
| | Nitrogen oxides | ≦10ppm | ≦1ppm |
| | Hydro-carbons | ≦30ppm | ≦1ppm |

APPARATUS FOR FORMING PROTECTIVE FILMS IN WATER FEED PIPES OF BOILER

BACKGROUND OF THE INVENTION

1. Field of the Invention

The present invention relates generally to an apparatus for forming a protective film on the inner surface of a water feed pipe. More particularly, the present invention relates to an apparatus for forming a corrosion-preventing protective film on the inner surface of a water feed pipe, for example, for feeding a condensate from a condenser to a boiler in a steam power plant.

2. Description of the Related Art

In a steam power plant, a steam turbine is connected to a power generator, and the generator is driven by the rotation of the steam turbine to generate power. For rotating the steam turbine, a boiler, which heats water into steam is provided. The steam generated in the boiler is blown against the steam turbine to rotate the turbine. The steam blown against the steam turbine is condensed by the condenser, and the resulting condensate is fed back to the boiler. A water feed pipe made of carbon steel runs between the condenser and the boiler, and the condensate is fed back to the boiler through this water feed pipe.

In the step where the steam generated in the boiler is blown against the steam turbine to drive the generator, impurities are liable to be included in the steam. Accordingly, when the steam is condensed by the condenser, the resulting condensate contains impurities, so that the carbon steel water feed pipe is corroded by the impurity-containing condensate.

There have been proposed so far various methods for preventing such corrosion. For example, Japanese Unexamined Patent Publication No. Hei 2-157503 discloses a method, in which a very small amount of oxygen is injected from an oxygen bomb into the condensate flowing through the water feed pipe to be dissolved in the condensate. An iron oxide (particularly trivalent iron oxide [$Fe_2O_3$]) protective film is formed on the inner surface of the water feed pipe by allowing the condensate containing oxygen dissolved therein to flow within the water feed pipe, and thus the water feed pipe is prevented from undergoing corrosion by this protective film.

However, it is difficult to dissolve oxygen homogeneously in the condensate merely by injecting gaseous oxygen directly into the condensate flowing in the water feed pipe. Accordingly, the iron oxide protective film is not hardly formed uniformly over the entire inner surface of the water feed pipe.

SUMMARY OF THE INVENTION

It is an objective of the present invention to provide an apparatus for forming a protective film in a water feed pipe of a boiler, which enable formation of the corrosion-preventing protective film uniformly and securely over the entire inner surface of the pipe.

To achieve the above objects, the apparatus according to the present invention includes a boiler for receiving water from a water feed pipe and heating the water into steam and a condenser for condensing the steam into condensate. The condensate is fed back to the boiler through the water feed pipe. A solute source includes a solute having at least one of oxygen, hydrogen peroxide and ozone. Generating member generates an aqueous solution by dissolving the solute supplied from the solute source into water. Supplying member supplies the aqueous solution to the water feed pipe to form a protective film made of iron oxide on an inner surface of the water feed pipe.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

FIG. 2 is a table showing gaseous components contained in the oxygen in an oxygen bomb in comparison with those contained in the oxygen produced according to the PSA (Pressure Swing Adsorption) method;

DETAILED DESCRIPTION OF THE PREFERRED EMBODIMENTS

First Embodiment

A first embodiment of the present invention will be described below referring to FIG. 1.

Figure 1:
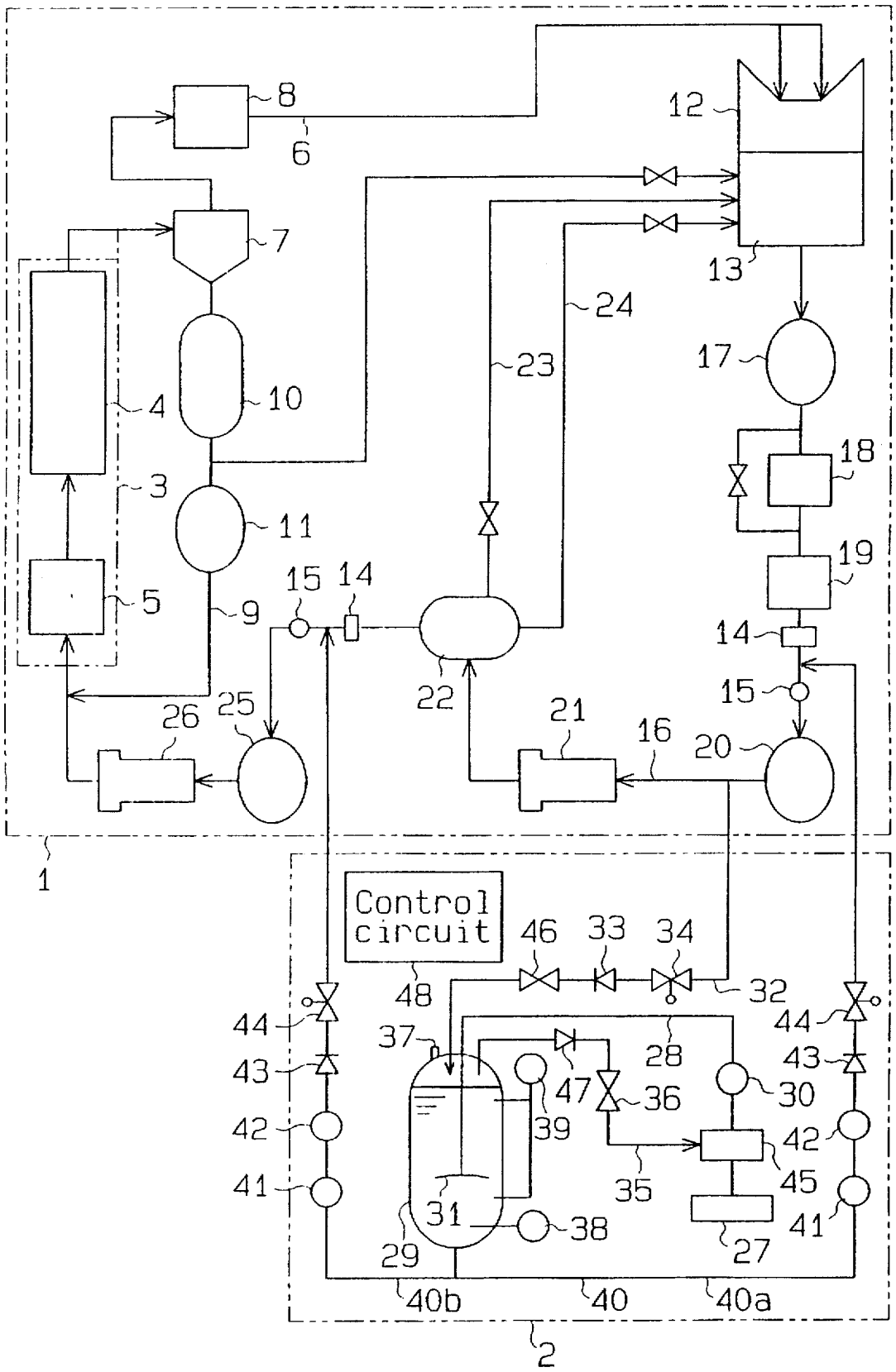
FIG. 1 is a schematic view of a steam power plant and a protective film forming apparatus according to a first embodiment of the present invention.

As shown in FIG. 1, a steam power plant 1 has a boiler 3. The boiler 3 has a furnace 4 and an economizer 5 connected to the furnace 4. A water pipe (not shown) is distributed in the furnace 4, and the water pipe is heated by combustion gas to convert the water flowing through the water pipe into steam. The economizer 5 recovers combustion gas exhausted from the furnace 4 to preheat the water fed to the furnace 4.

A steam pipe 6 is connected at the proximal end to a steam blowoff port of the furnace 4. A separator 7 is located above the steam pipe 6. A superheater 8 is located on the steam pipe 6 on the downstream side of the separator 7. The separator 7 separates water drops contained in the steam blown out of the steam blowoff port of the furnace 4 and feeds only the steam to the superheater 8. The superheater 8 heats the steam to a higher temperature.

The separator 7 is connected to the economizer 5 via a drain pipe 9. A drain tank 10 and a circulating pump 11 are located on the drain pipe 9. The drain tank 10 recovers the water drops separated from the steam by the separator 7. The circulating pump 11 feeds the water drops recovered in the drain tank 10 to the economizer 5 through the drain pipe 9.

A steam turbine 12 is connected to the downstream end of the steam pipe 6. The steam passed through the steam pipe 6 is blown against vanes of the steam turbine 12 to rotate the turbine 12. A power generator (not shown) is connected to the steam turbine 12 and is driven by the rotation of the steam turbine 12 to generate power. A condenser 13 is connected to the steam turbine 12 and has a plurality of cooling pipes (not shown) through which cooling water such as sea water is passed. The steam passed through the steam turbine 12 is brought into contact with the outer surfaces of the cooling pipes of the condenser 13 and is condensed.

The condenser 13 is connected to the economizer 5 of the boiler 3 through a carbon steel water feed pipe 16. A condensate pump 17 is located on the water feed pipe 16 at an upstream position to pump the condensate from the condenser 13 to the economizer 5. An electromagnetic filter 18 is located on the water feed pipe 16 on the downstream side of the condensate pump 17 to filter off metal oxides such as those of iron and copper contained in the condensate fed from the condensate pump 17. A demineralizer 19 is located on the water feed pipe 16 on the downstream side of the electromagnetic filter 18. The demineralizer 19 removes not only salinity dissolved in the condensate but also gases such as oxygen, carbon dioxide and other gaseous components contained in the condensate.

A booster pump 20, a first heater 21 and a deaerator 22 are located on the water feed pipe 16 on the downstream side of the demineralizer 19. The booster pump 20 increases the pressure of the condensate flowing through the water feed pipe 16 and feeds the resulting condensate to the first heater 21. The first heater 21 increases the temperature of the condensate before it flows into the deaerator 22. The deaerator 22 boils the condensate passed through the first heater 21 to remove gaseous components such as oxygen, carbon dioxide and other gaseous components contained in the condensate. The steam generated when the condensate is boiled in the deaerator 22 is fed back to the condenser 13 through a vent pipe 23 and a return pipe 24.

A water feed pump 25 and a second heater 26 are located on the water feed pipe 16 on the downstream side of the deaerator 22. The water feed pump 25 pumps the condensate passed through the deaerator 22 to the economizer 5 of the boiler 3 through the second heater 26. The second heater 26 heats the condensate to a predetermined temperature level before it is pumped to the economizer 5.

Flow meters 14 and oxygen analyzers 15 are located on the water feed pipe 16 between the demineralizer 19 and the booster pump 20, and between the deaerator 22 and the water feed pump 25, respectively. These flow meters 14 detect the flow rate of the condensate flowing through the water feed pipe 16 to output a detection signal to a control circuit 48. Meanwhile, the oxygen analyzers 15 detect the level of oxygen dissolved in the condensate flowing through the water feed pipe 16 to output a detection signal to the control circuit 48.

A protective film forming apparatus 2 has an oxygen generator 27. The oxygen generator 27 has a compressor (not shown) for compressing air. In this embodiment, the oxygen generator 27 is for producing a high-purity oxygen according to the PSA (Pressure Swing Adsorption) method. PSA is a method of producing a high-purity oxygen (80.0% to 99.5%) by bringing air into contact with zeolite under high pressure to allow nitrogen, carbon monoxide, carbon dioxide, nitrogen oxides, hydrocarbons, etc., contained in the air to be adsorbed on zeolite. Zeolite is an adsorbent having a multiplicity of uniform micropores having a size close to the molecular diameter of the gases on the order of Å ($10^{-8}$ cm). Cations in the crystal structure of zeolite exert electrostatic attractive force against the molecules of the gases to be adsorbed including nitrogen. Accordingly, even if the molecular diameter of oxygen is slightly smaller than those of the gaseous components to be adsorbed, the to-be-adsorbed gaseous components having higher polarity levels are adsorbed on the electrostatic field of zeolite. Thus, oxygen can be separated from these gaseous components adsorbed. Subsequently, pressure is reduced or increased to cause a pressure difference to remove the gaseous components adsorbed on the zeolite. By repeating the above procedures, zeolite can be regenerated so that it can adsorb such gaseous components many times, and thus zeolite can be used indefinitely.

An oxygen supply pipe 28 has an inlet communicating with the oxygen generator 27 and an outlet communicating with an oxygen dissolving tank 29. A diffuser 31 is attached to the outlet of the oxygen supply pipe 28 and is located in the dissolving tank 29. A buffer tank 45 and a compressor 30 are located on the oxygen supply pipe 28. The buffer tank 45 is for storing a predetermined amount of oxygen generated by the oxygen generator 27. The buffer tank 45 has a pressure switch (not shown) which is turned on or off in response to the pressure in the tank 45. The oxygen generator 27 is selectively operated and stopped based on the on-off control of the pressure switch such that the inner pressure of the buffer tank 45 is maintained at 1.0 Kgf/cm$^2$. The oxygen fed from the buffer tank 45 is compressed by the compressor 30, and the thus compressed oxygen is diffused into the dissolving tank 29 via the diffuser 31. Thus, the oxygen is dissolved in the condensate poured into the dissolving tank 29. The condensate in which oxygen is dissolved shall be hereinafter referred to as oxygen water. In this embodiment, the temperature of the condensate in the dissolving tank 29 is set to be 30° to 40° C.

A water pouring pipe 32 has an inlet communicating with the water feed pipe 16 on the downstream side of the booster pump 20 and an outlet connected to the top of the dissolving tank 29. A motor operated valve 34, a check valve 33 and a reducing valve 46 are located on the water pouring pipe 32. The motor operated valve 34 adjust the flow rate of the condensate fed from the water feed pipe 16 to the dissolving tank 29 through the water pouring pipe 32. The aperture of the motor operated valve 34 is controlled by the control circuit 48.

A relief pipe 35 has an inlet communicating with the top of the dissolving tank 29 and an outlet communicating with the buffer tank 45. A check valve 47 and a reducing valve 36 are located on the relief pipe 35. A portion of the oxygen that was fed to the dissolving tank 29 that failed to dissolve in the condensate contained in the tank 29 is passed through the relief pipe 35, and after pressure reduction through the reducing valve 36, is released into the buffer tank 45. The dissolving tank 29 has a safety valve 37. The safety valve 37 is provided for preventing the internal pressure of the dissolving tank 29 from exceeding a predetermined level. The valve 37 is designed to open itself automatically whenever the internal pressure of the tank 29 exceeds the predetermined level.

The dissolving tank 29 has an oxygen analyzer 38 and a level sensor 39. The oxygen analyzer 38 detects the level of oxygen dissolved in the condensate contained in the dissolving tank 29 and sends a detection signal to the control circuit 48. Meanwhile, the level sensor 39 detects the water level of the condensate contained in the dissolving tank 29 and sends a detection signal to the control circuit 48. The control circuit 48 controls opening and closing of the motor operated valve 34 based on the detection signal sent from the level sensor 39.

An oxygen water supply pipe 40 has an inlet connected to the bottom of the dissolving tank 29. This supply pipe 40 has a first branch pipe 40*a* and a second branch pipe 40*b*. The first branch pipe 40*a* has an outlet communicating with the water feed pipe 16 between the booster pump 20 and the demineralizer 19. The second branch pipe 40b has an outlet communicating with the water feed pipe 16 between the deaerator 22 and the water feed pump 25.

Injection pumps 41, flow meters 42, check valves 43 and motor operated valves 44 are located on the branch pipes 40a,40b, respectively. The injection pumps 41 pump the oxygen water contained in the dissolving tank 29 to send it through the branch pipes 40a,40b into the water feed pipe 16. The control circuit 48 controls operation of the injection pumps 41 based on the detection signals sent from the oxygen analyzers 15, respectively, so as to maintain the oxygen content of the condensate in the water feed pipe 16 at a predetermined level.

In this embodiment, the temperature of the condensate flowing through the water feed pipe 16 is about 30° to 40° C. between the condensate pump 17 and the first heater 21, is about 120° C. between the first heater 21 and the deaerator 22, is about 180° C. between the deaerator 22 and the second heater 26, and is about 290° C. between the second heater 26 and the economizer 5. The flow rate of the condensate flowing through the water feed pipe 16 is 800 to 2000 tons/min. The oxygen content of the condensate flowing through the water feed pipe 16 is maintained at 150 ppb. The injection pressure when the oxygen water is injected to the water feed pipe 16 is 7 to 8 $Kg/cm^2$ at the outlet of the first branch pipe 40a and 9.8 $Kg/cm^2$ at the outlet of the second branch pipe 40b.

A trivalent iron oxide ($Fe_2O_3$) is formed as a protective film on the inner wall surface of the water feed pipe 16 by bringing the oxygen water into contact with the inner wall surface of the water feed pipe 16. The thus formed protective film prevents the water feed pipe 16 from undergoing corrosion. The trivalent iron oxide has poor solubility in water.

Next, actions and effects of the first embodiment will be described.

First, procedures of feeding condensate to the boiler 3 in the steam power plant 1 will be described.

The steam blown out of the steam blowoff port of the furnace 4 in the boiler 3 passes through the steam pipe 6 and is blown against the steam turbine 12 to rotate the steam turbine 12. The steam passed through the steam turbine 12 is cooled by the condenser 13 into a condensate. Subsequently, metal oxides such as of iron and copper contained in the condensate are filtered off by the electromagnetic filter 18. Then, the demineralizer 19 removes not only the salinity dissolved in the condensate but also oxygen and carbon dioxide gases contained in the condensate.

Next, the thus treated condensate is fed by the booster pump 20 through the first heater 21 to the deaerator 22, where oxygen, carbon dioxide and other gaseous components dissolved in the condensate are removed. Subsequently, the condensate is pumped by the water feed pump 25 through the second heater 26 to the economizer 5 of the boiler 3. Thus, the steam generated in the boiler 3 is cooled into a condensate by the condenser 13 after rotating the steam turbine 12, and the condensate is fed back to the boiler 3 through the water feed pipe 16.

Next, actions of the protective film forming apparatus 2 in the process that the condensate is fed back to the boiler 3 will be described.

First, the motor operated valve 34 is opened by the control circuit 48. Then, the condensate flowing through the water feed pipe 16 is partly diverted into the water pouring pipe 32 on the downstream side of the booster pump 20 to be fed into the dissolving tank 29. When the control circuit 48 estimates that the dissolving tank 29 is filled with the condensate based on the detection signal from the level sensor 39, it closes the motor operated valve 34.

The oxygen generated in the oxygen generator 27 is force-fed through the oxygen supply pipe 28 by the compressor 30 to be diffused into the condensate in the dissolving tank 29 via the diffuser 31. By this oxygen diffusion, the oxygen is dissolved in the condensate to form oxygen water.

The internal pressure of the dissolving tank 29 increases as oxygen is released through the diffuser 31. However, the internal pressure of the dissolving tank 29 is designed to be maintained not to exceed a predetermined level by the safety valve 37. The portion of oxygen which failed to dissolve in the condensate in the dissolving tank 29 is fed back to the buffer tank 45 through the relief pipe 35.

Upon formation of the oxygen water, the injection pumps 41 are operated by the control circuit 48, and the oxygen water contained in the dissolving tank 29 is fed through the oxygen water supply pipe 40 into the water feed pipe 16. As a result, the oxygen water is admixed with the condensate flowing through the water feed pipe 16. In this process, the amount of the oxygen water to be fed to the water feed pipe 16 is controlled by the control circuit 48 so that the condensate in the water feed pipe 16 may have an oxygen content of 150 ppb. A protective film of trivalent iron oxide is formed on the inner wall surface of the water feed pipe 16 by bringing the condensate admixed with the oxygen water into contact with the inner wall surface of the water feed pipe 16. The thus formed protective film prevents the water feed pipe 16 from being corroded by the corrosive materials contained in the condensate. Since, the trivalent ion oxide scarcely dissolves in water even if contacted with the corrosive materials, the protective film formed can be maintained for an extended period.

As described above, in this embodiment, oxygen is not directly injected into the condensate flowing through the water feed pipe 16 but an oxygen water formed beforehand in the dissolving tank 29 is designed to be injected into the condensate flowing through the water feed pipe 16. Since the oxygen water assumes a liquid form, it can be mixed smoothly and homogeneously with the condensate flowing through the water feed pipe 16. In other words, oxygen can be dissolved smoothly and homogeneously in the condensate flowing through the water feed pipe 16. Accordingly, a protective film of iron oxide can be formed uniformly and securely on the inner wall surface of the water feed pipe 16 surely inhibiting corrosion of the water feed pipe 16.

The positions where the oxygen water is supplied to the water feed pipe 16 are on the downstream sides of the demineralizer 19 and the deaerator 22, respectively. Accordingly, although oxygen contained in the condensate may be removed by the deaerating actions of these units 19,22, they will not affect the oxygen water supplied to the water feed pipe 16 downstream of there units 19,22.

The oxygen water is formed by utilizing a portion of the condensate discharged from the condenser 13. Accordingly, there is no need of introducing water from an extra water source for forming the oxygen water. In addition, the oxygen water and the condensate containing the oxygen water are fed back through the water feed pipe 16 to the boiler 3, where they are converted into steam, and the steam is reconverted into water by the condenser 13 to be fed back again through the water feed pipe 16 to the boiler 3. That is, the water employed in the steam power plant 1 can be re-used time and time again without being discharged from the circulating route. Therefore, the running cost of forming the oxygen water is minimized.

FIG. 2 is a table showing gaseous components contained in the oxygen in an oxygen bomb (hereinafter referred to as bomb oxygen) in comparison with those contained in the oxygen produced according to the PSA method (hereinafter referred to as PSA oxygen). As shown in FIG. 2, both the bomb oxygen and the PSA oxygen contain corrosive gases. However, the levels of carbon monoxide, carbon dioxide and nitrogen oxides in the PSA oxygen are about one tenth of that of the bomb oxygen. Particularly, the level of hydrocarbons in the PSA oxygen is about a thirtieth of that of the bomb oxygen.

As described above, the levels of corrosive gases contained in the PSA oxygen are much lower than those of the corrosive gases contained in the bomb oxygen, so that an oxygen water having extremely low corrosive gas contents is formed. Accordingly, the possibility that the internal wall surface of the water feed pipe 16 is corroded by the corrosive gases contained in the oxygen water when it is fed into the condenser flowing through the water feed pipe 16 is much lower. Consequently, an iron oxide protective film can be securely formed on the inner wall surface of the water feed pipe 16.

Oxygen can be stored in the buffer tank 29 at a very low pressure compared with the oxygen bomb. Accordingly, there is no need for installing a structure for preventing rupture of the tank 29 around it or of providing the space for installing the structure.

The oxygen generator 27 can continuously produce oxygen according to the PSA method. Accordingly, there are no troublesome procedures for bomb replacement, which facilitates lower cost, maintenance and management of the oxygen generator 27.

Second Embodiment

A second embodiment of the present invention will be described referring to FIG. 3. The constitution of the steam power plant 1 in this embodiment is the same as that of the steam power plant 1 in the first embodiment, so that the similar units and members are called the same and affixed with the same reference numbers, respectively. Accordingly, detailed description of such units and members will be omitted, and differences will mainly be described below.

Figure 3:
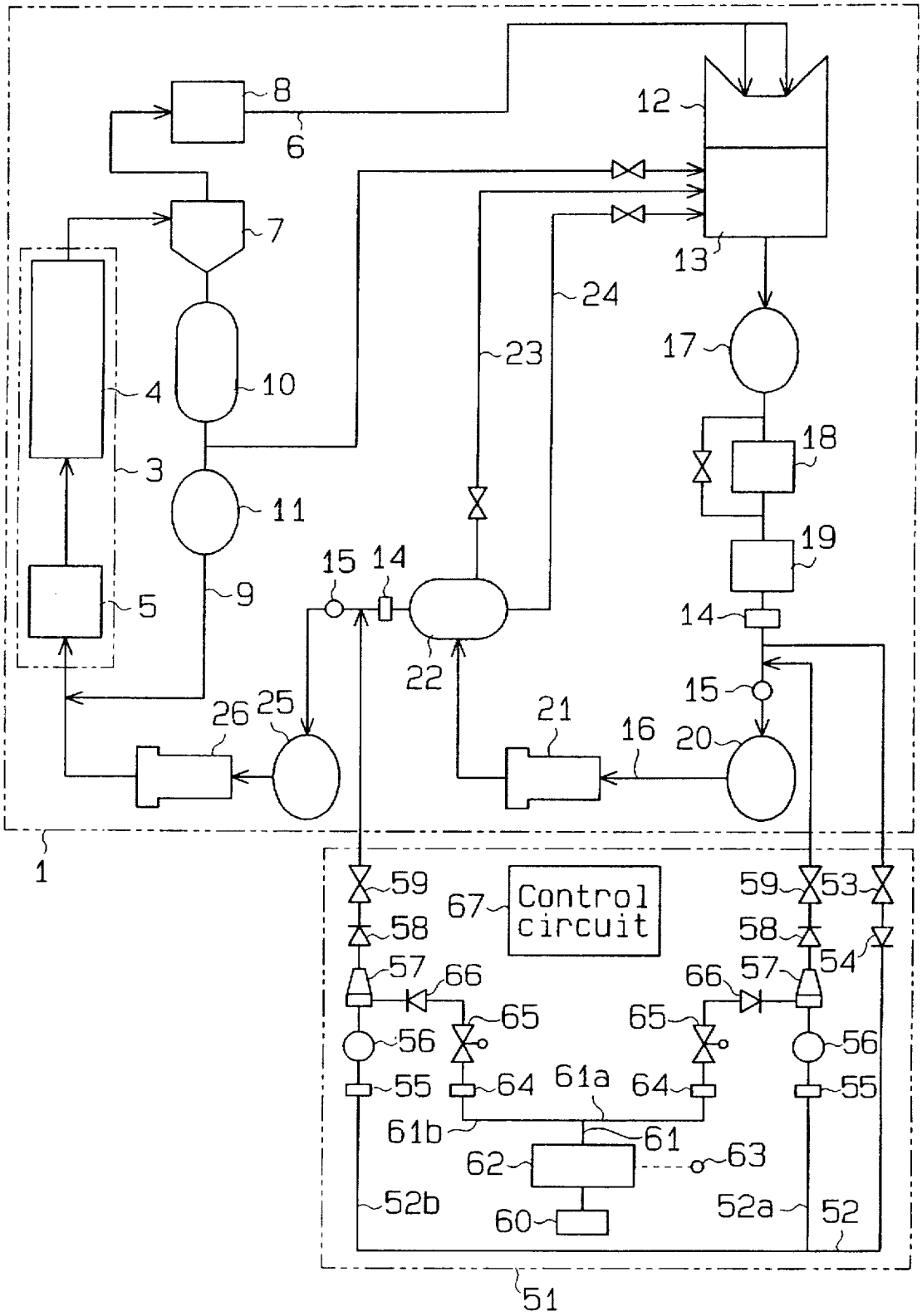
FIG. 3 is a schematic view of a steam power plant and a protective film forming apparatus according to a second embodiment of the present invention.

As shown in FIG. 3, a protective film forming apparatus 51 has a bypass pipe 52. The bypass pipe 52 has an inlet communicating with the water feed pipe 16 between the demineralizer 19 and the booster pump 20. The bypass pipe 52 has a first branch pipe **52*a* and a second branch pipe 52*b*. The first branch pipe 52*a* has an outlet communicating with the water feed pipe 16 between the demineralizer 19 and the booster pump 20. The second branch pipe 52*b* has an outlet communicating with the water feed pipe 16 between the deaerator 22 and the water feed pump 25. A motor operated valve 53 and a check valve 54 are located between the inlet of the bypass pipe 52 and the branch point of the branch pipes 52*a*,52*b***.

Flow meters 55, booster pumps 56, ejectors 57, check valves 58 and motor operated valves 59 are located on the branch pipes **52*a*,52*b*. The flow meters 55 detect flow rate of the condensate flowing through the branch pipes 52*a*,52*b* and sends detection signals to a control circuit 67, respectively. The control circuit 67 controls the booster pumps 56 based on the detection signals from the flow meters 55 such that the flow rate of the condensate flowing through the branch pipes 52*a*,52*b* may be at a predetermined value (100 L/min). The ejectors 57 contain nozzles. The condensate pumped from the booster pumps 56 is jetted from the nozzles at a high speed. The motor operated valves 59 are controlled by the control circuit 67**.

An oxygen generator 60 is for producing high-purity oxygen according to the PSA method like in the first embodiment. An oxygen supply pipe 61 has an inlet communicating with the oxygen generator 60. The oxygen supply pipe 61 has a first branch pipe **61*a* and a second branch pipe 61*b*. These branch pipes 61*a*,61*b* have outlets communicating with the ejectors 57, respectively. Oxygen introducing sections in the ejectors 57 (portions corresponding to the outlets of the branch pipes 61*a*,61*b*) assume negative pressure when the condensate is jetted out of the nozzles of the ejectors 57 at a high speed. Accordingly, the oxygen in the branch pipes 61*a*,61*b* is sucked into the ejectors 57** and is mixed with the condensate to be jetted out of the nozzles.

A buffer tank 62 is located on the oxygen supply pipe 61. The buffer tank 62 has an oxygen analyzer 63. The oxygen analyzer 63 detects oxygen content in the buffer tank 62 to send a detection signal to the control circuit 67. Flow meters 64, flow regulating valves 65 and check valves 66 are located on the branch pipes **61*a*,61*b*, respectively. The flow meters 64 detect the flow rate of oxygen flowing through the branch pipes 61*a*,61*b* to send detection signals to the control circuit 67. The control circuit 67 determines the flow rate of oxygen to be supplied to the ejectors 57 based on the detection signal from the oxygen analyzer 63 to control the aperture of the flow regulating valves 65**.

The temperature and flow rate of the condensate flowing through the water feed pipe 16 in this embodiment are the same as in the first embodiment. The control circuit 67 controls the flow regulating valves 65 such that the oxygen content in the condensate flowing through the water feed pipe 16 is maintained at 100 ppb. The pressure of the condensate flowing through the bypass pipe 52 is 7 to 8 $Kg/cm^2$ between the inlet of the bypass pipe 52 and the respective booster pumps 56. The oxygen water is pressurized by the booster pumps 56 so that the pressure of the oxygen water from the bypass pipe 52 to the water feed pipe 16 is 9.9 $Kg/cm^2$ or more.

Next, actions and effects of the thus constituted second embodiment will be described. It should be appreciated that a predetermined amount of oxygen is already supplied from the oxygen generator 60 into the buffer tank 62.

As the condensate is jetted out of the nozzles of the ejectors 57, the oxygen in the buffer tank 62 is sucked into the ejectors 57 through the oxygen supply pipe 61 and is mixed with the condensate to be jetted out of the nozzles. Thus, the oxygen is dissolved in the condensate, and an oxygen water is formed. The oxygen water is supplied from the outlets of the branch pipes **52*a*,52*b* of the bypass pipe 52 into the water feed pipe 16. As a result, the oxygen water is mixed homogeneously with the condensate flowing through the water feed pipe 16 to form a protective film of trivalent iron oxide on the inner wall surface of the water feed pipe 16**.

The control circuit 67 recognizes the oxygen content in the buffer tank 62 based on the detection signal from the oxygen analyzer 63. The control circuit 67 determines the flow rate of oxygen to be supplied to the ejectors 57 depending on the detected oxygen content value to control the aperture of the flow regulating valves 65. Thus, a predetermined concentration of oxygen water is formed, and the oxygen content of the condensate flowing through the water feed pipe 16 can be maintained at 100 ppb by supplying the oxygen water into the water feed pipe 16.

The same actions and effects as in the first embodiment can be obtained also in the second embodiment.

In this embodiment, the oxygen water is formed by admixing in the ejectors 57 oxygen to the condensate jetted out at a high speed. According to this method, oxygen is not used wastefully but is dissolved efficiently in the condensate, so that not only the amount of oxygen to be used but also the cost of forming the oxygen water is reduced.

Third Embodiment

Next, a third embodiment of the present invention will be described referring to FIG. 4.

Figure 4:
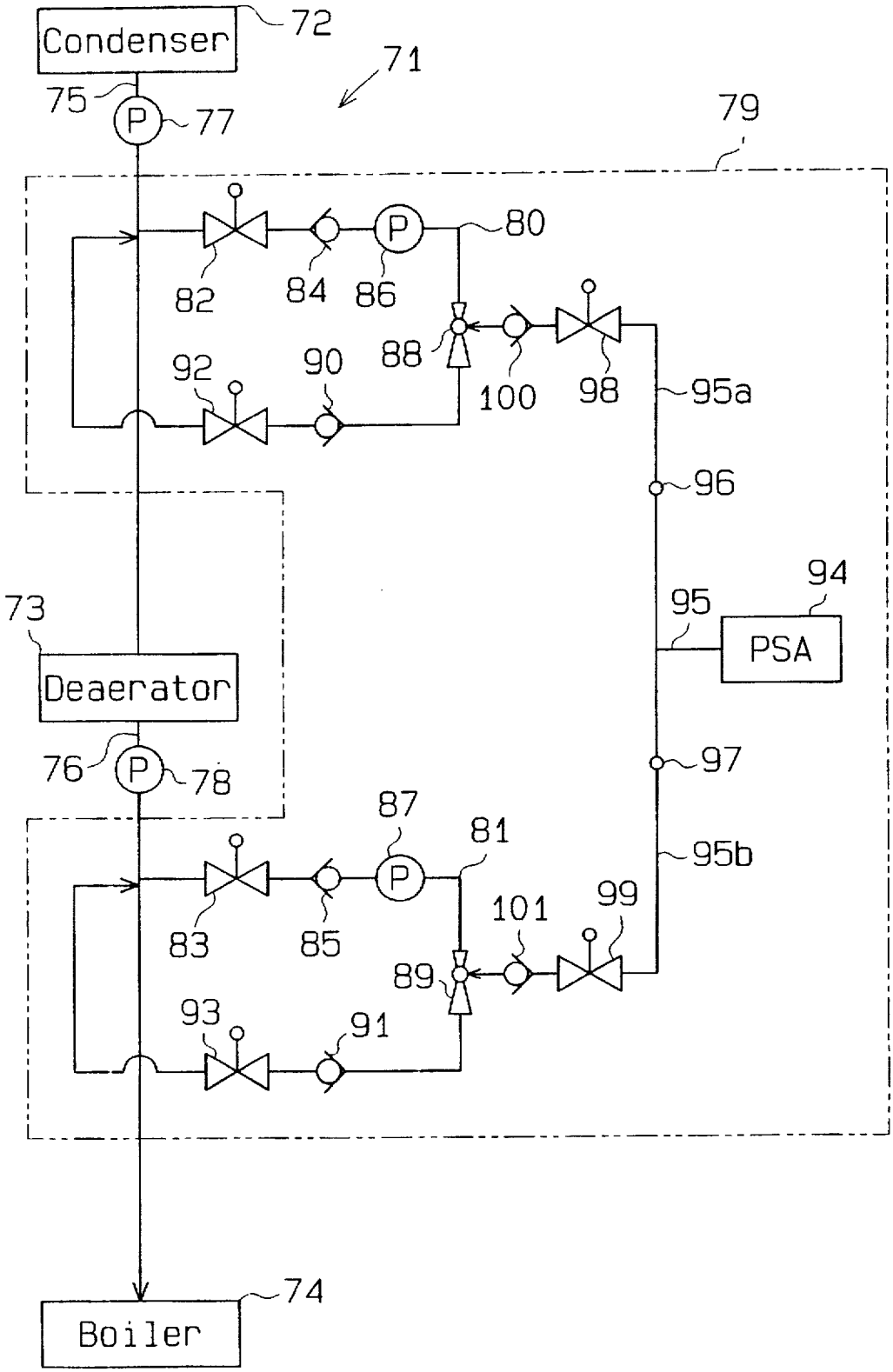
FIG. 4 is a schematic view of a protective film forming apparatus according to a third embodiment of the present invention.

As shown in FIG. 4, a steam power plant 71 has a condenser 72, a deaerator 73 and a boiler 74. The steam power plant 71 in this embodiment is the same as those in the foregoing embodiments, thus the constitution of the steam power plant 71 depicted in FIG. 4 is simplified. A first water feed pipe 75 made of carbon steel connects the condenser 72 and the deaerator 73. A second water feed pipe 76, also made of carbon steel, connects the deaerator 73 and the boiler 74. A booster pump 77 is located on the first water feed pipe 75 to pump the condensate from the condenser 72 through the first water feed pipe 75 to the deaerator 73. A water feed pump 78 is located on the second water feed pipe 76 to pump the condensate from the deaerator 73 through the second water feed pipe 76 to the boiler 74.

A protective film forming apparatus 79 has a first bypass pipe 80 and a second bypass pipe 81. The first bypass pipe 80 has an inlet connected to a position upstreams the first water feed pipe 75 and an outlet also cnnected to the first water feed pipe 75 adjacent to and on the downstream side of the inlet. The second bypass pipe 81 has an inlet cnnected to a position upstreams the second water feed pipe 76 and an outlet also connected to the second water feed pipe 76 adjacent to and on the downstream side of the inlet.

First motor operated valves 82,83, check valves 84,85, pumps 86,87, ejectors 88,89, check valves 90,91 and second motor operated valves 92,93 are located on the bypass pipes 80,81, respectively. The first and second motor operated valves 82,83,92,93 open and close the bypass pipes 80,81, respectively. When the pumps 86,87 are operated in the state where the bypass pipes 80,81 are opened by the motor operated valves 82,83,92,93, the condensate flowing through the water feed pipes 75,76 partly flows into the bypass pipes 80,81, respectively. The condensate flowing through the bypass pipes 80,81 is prevented from flowing backward from the outlet sides to the inlet sides by the check valves 84,85,90,91, respectively.

An oxygen generator 94 is for producing oxygen according to the PSA method like in the foregoing embodiments. An oxygen supply pipe 95 has an inlet communicating with the oxygen generator 94. The oxygen supply pipe 95 has a first branch pipe **95*a* and a second branch pipe 95*b*. These branch pipes 95*a*,95*b* have outlets communicating with the ejectors 88,89, respectively. As the condensate is jetted out of the nozzles of the ejectors 88,89 at a high speed, the oxygen in the branch pipes 95*a*,95*b* is sucked into the ejectors 88,89 and is mixed with the condensate to be jetted out of the nozzles. Thus, an oxygen water is formed, and the oxygen water is supplied into the first and second water feed pipes 75,76 from the outlets of the bypass pipes 80,81**.

Flow meters 96,97, flow regulating valves 98,99 and check valves 100,101 are located on the branch pipes **95*a*,95*b*, respectively. The flow meters. 96,97 detect the flow rate of oxygen flowing through the branch pipes 95*a*,95*b*, respectively. The flow regulating valves 98,99 adjust the flow rate of oxygen flowing through the branch pipes 95*a*,95*b* by changing their aperture. The oxygen flowing through the branch pipes 95*a*,95*b* is prevented from flowing backward by the check valves 100,101**.

Next, actions and effects of the thus constituted third embodiment will be described.

When the booster pump 77 and the water feed pump 78 are operated, the condensate from the condenser 72 is supplied through the first water feed pipe 75 to the deaerator 73 and further through the second water feed pipe 76 to the boiler 74.

Meanwhile, when the motor operated valves 82,83,92,93 are opened and the pumps 86,87 are operated, the condensate flowing through the water feed pipes 75,76 is partly diverted through the inlets of the bypass pipes 80,81 into the pipes 80,81 to flow through them toward the outlets. The condensate flowing through the bypass pipes 80,81 is mixed with oxygen fed from the oxygen generator through the oxygen supply pipe 95 when the condensate passes the ejectors 88,89. Thus, the oxygen is dissolved in the condensate, and oxygen water is formed. The oxygen water is supplied from the outlets of the bypass pipes 80,81 into the first and second water feed pipes 75,76. As a result, the oxygen water is mixed homogeneously with the condensate flowing through the first and second water reed pipes 75,76 to form protective films of iron oxide on the inner wall surfaces of the water feed pipes 75,76.

The pressure and temperature of the condensate flowing through the water feed pipes 75,76 increase toward the boiler 73. However, in this embodiment, the bypass pipes 80,81 for feeding the condensate introduced from the water feed pipes 75,76 back into the pipes 75,76, are independently connected to the first water feed pipe 75 between the condenser 72 and the deaerator 73 and to the second water feed pipe 76 between the deaerator 73 and the boiler 74. In addition, the inlets and outlets of the bypass pipes 80,81 are communicating with the water feed pipes 75,76 adjacent to each other, respectively. Accordingly, differences in the pressure and temperature of the condensate flowing through the water feed pipes 75,76 are small between the portions where the inlets of the bypass pipes 80,81 are connected and the portions where the outlets of the bypass pipes 80,81 are connected.

Accordingly, in order to feed back the condensate in the water feed pipes 75,76 introduced from the inlets of the bypass pipes 80,81 into the pipes 75,76 through the outlets of the pipes 80,81, the pumps 86,87 employed in this embodiment may have a smaller pumping force than those employed in the foregoing embodiments. Meanwhile, the difference is small between the temperature of the condensate introduced from the inlets of the bypass pipes 80,81 into the water feed pipes 75,76 and the temperature of the condensate in the water feed pipe 75,76 at the portions where the outlets of the bypass pipes 80,81 are connected. Accordingly, when the oxygen water is supplied from the outlets of the bypass pipes 80,81 into the water feed pipes 75,76, the temperature of the condensate in the water feed pipes 75,76 is prevented from lowering at the outlets of the bypass pipes 80,81. Thus, thermal efficiency is improved in this embodiment over the foregoing embodiments.

Fourth Embodiment

Next, a fourth embodiment of the present invention will be described referring to FIGS. 5 and 6. The steam power plant 110 in this embodiment is also the same as those in the foregoing embodiments, thus the constitution of the steam power plant 110 depicted in FIG. 5 is simplified.

Figure 5:
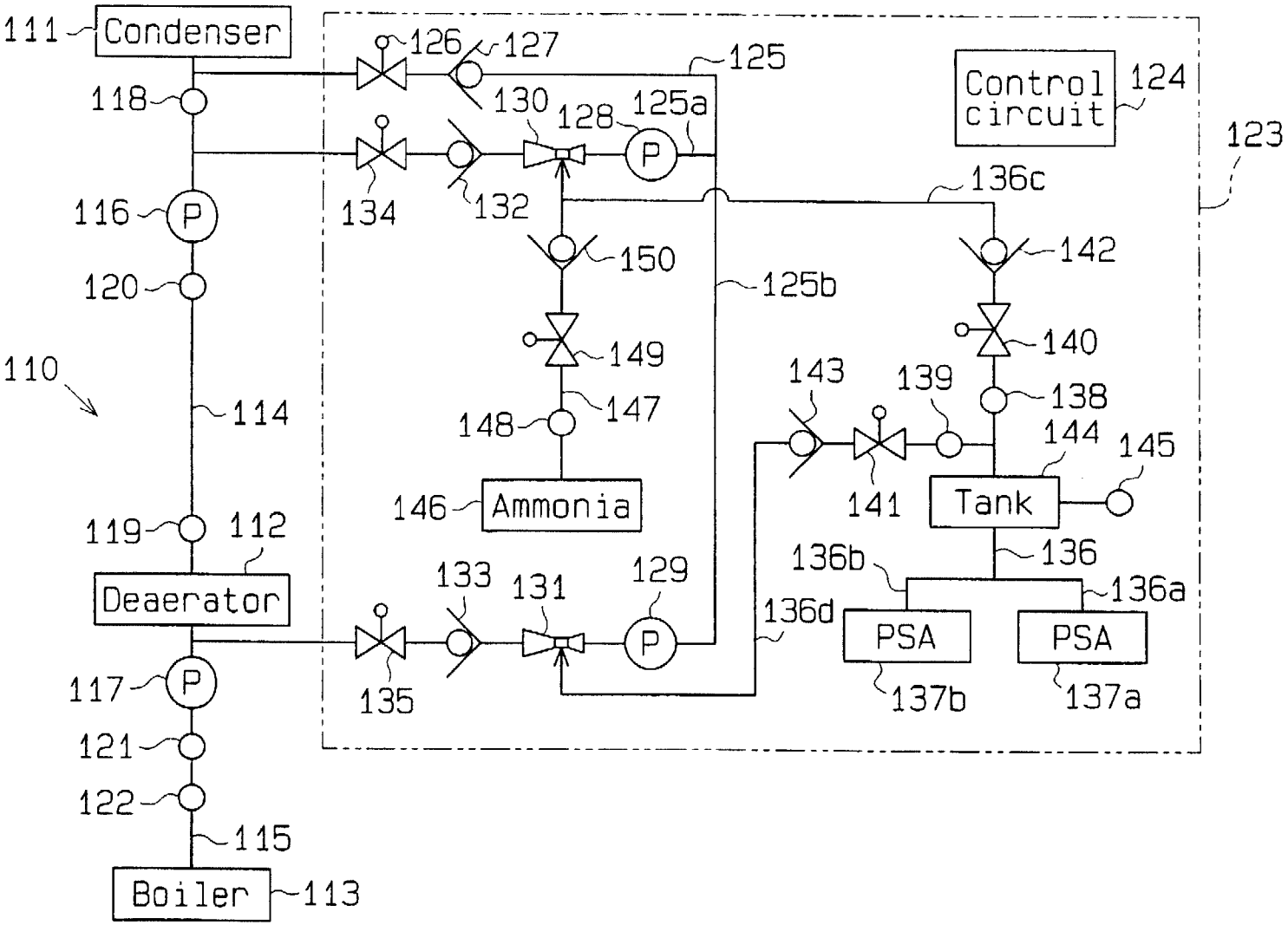
FIG. 5 is a schematic view of a protective film forming apparatus according to a fourth embodiment of the present invention.

As shown in FIG. 5, the steam power plant 110 has a condenser 111, a deaerator 112 and a boiler 113. A first water feed pipe 114 made of carbon steel connects the condenser 111 and the deaerator 112. A second water feed pipe 115 also made of carbon steel connects the deaerator 112 and the boiler 113. A booster pump 116 is located on the first water feed pipe 114 to pump the condensate from the condenser 111 through the first water feed pipe 114 to the deaerator 112. A water feed pump 117 is located on the second water feed pipe 115 to pump the condensate from the deaerator 112 through the second water feed pipe 115 to the boiler 113.

Conductivity sensors 118,119 and a flow meter 120 are located on the first water feed pipe 114. The conductivity sensors 118,119 detect pH-dependent conductivity of the condensate flowing through the first water feed pipe 114. The flow meter 120 detects the flow rate of the condensate flowing through the first water feed pipe 114. Another flow meter 121 and an oxygen analyzer 122 are located on the second water feed pipe 115. The flow meter 121 detects the flow rate of the condensate flowing through the second water feed pipe 115. The content meter 122 detects the content of oxygen dissolved in the condensate flowing through the second water feed pipe 115.

A protective film forming apparatus 123 has a control circuit 124 for controlling actions of the entire apparatus 123. The control circuit 124 contains a CPU (central processing unit) and ROM (read only memory) storing various programs for operating the CPU.

The protective film forming apparatus 123 has a bypass pipe 125. The bypass pipe 125 has an inlet communicating with the first water feed pipe 114. The bypass pipe 125 has a first branch pipe 125*a* and a second branch pipe 125*b*. The first branch pipe 125*a* has an outlet communicating with the first water feed pipe 114, whereas the second branch pipe 125*b* has an outlet communicating with the second water feed pipe 115.

A motor operated valve 126 and a check valve 127 are interposed between the inlet of the bypass pipe 125 and the branch point of the branch pipes 125*a*,125*b*. Pumps 128,129, ejectors 130,131, check valves 132,133 and motor operated valves 134,135 are located on the branch pipes 125*a*,125*b*, respectively. The motor operated valves 126,134,135 open and close the bypass pipe 125, respectively. When the pumps 128,129 are operated in the state where the bypass pipe 125 is opened by the motor operated valves 126,134,135, the condensate flowing through the first water feed pipes 114 is partly diverted into the bypass pipe 125 to be supplied through the branch pipes 125*a*,125*b* to the first and second water feed pipes 114,115, respectively.

An oxygen supply pipe 136 has at an upstream position a first branch pipe 136*a* and a second branch pipe 136*b* and at a downstream position a third branch pipe 136*c* and a fourth branch pipe 136*d*. The first and second branch pipes 136*a*, 136*b* have inlets communicating with oxygen generators 137*a*,137*b*, respectively. These oxygen generators 137*a*, 137*b* also produce oxygen according to the PSA method like in the foregoing embodiments. The third and fourth branch pipes 136*c*,136*d* have outlets communicating with the ejectors 130,131, respectively. Flow meters 138,139, flow regulating valves 140,141 and check valves 142,143 are located on the third and fourth branch pipes 136*c*,136*d*, respectively. The flow meters 138,139 detect the flow rate of oxygen flowing through the branch pipes 136*c*,136*d* respectively. The flow regulating valves 140,141 adjust the flow rate of oxygen flowing through the branch pipes 136*c*,136*d* by changing their apertures.

A buffer tank 144 is located on the oxygen supply pipe 136 between the branch point of the first and second branch pipes 136*a*,136*b* and the branch point of the third and fourth branch pipes 136*c*,136*d*. The oxygen generated in the oxygen generators 137*a*,137*b* passes through the first and second branch pipes 136*a*,136*b* and is stored temporarily in the buffer tank 144. The buffer tank 144 has a pressure sensor 145 for detecting the internal pressure of the tank 144.

An ammonia tank 146 stores an aqueous ammonia solution. The aqueous ammonia solution has an ammonia content of about 3%. An ammonia supply pipe 147 has an inlet communicating with the ammonia tank 146 and an outlet communicating with the ejector 130.

A flow meter 148, a flow regulating valve 149 and a check valve 150 are located on the ammonia supply pipe 147. The flow meter 148 detects the flow rate of the aqueous ammonia solution flowing through the ammonia supply pipe 147. The flow regulating valve 149 adjusts the flow rate of the aqueous ammonia solution flowing through the ammonia supply pipe 147 by changing its aperture. The check valve 150 prevents the aqueous ammonia solution flowing through the ammonia supply pipe 147 from flowing backward.

The condensate flowing through the first branch pipe 125*a* of the bypass pipe 125 is jetted, when it passes through the ejector 130, at a high speed out of the nozzle of the ejector 130. With the jetting out of the condensate, the oxygen in the third branch pipe 136*c* of the oxygen supply pipe 136 is sucked into the ejector 130 and is mixed with the condensate to be jetted out of the nozzle. Simultaneously, the aqueous ammonia solution in the ammonia supply pipe 147 is sucked into the ejector 130 and is mixed with the condensate to be jetted out of the nozzle. Thus, an ammonia-containing oxygen water is formed, and the resulting oxygen water is supplied from the outlet of the first branch pipe 125*a* of the bypass pipe 125 into the first water feed pipe 114.

Next, the electrical constitution of the protective film forming apparatus 123 will be described referring to FIG. 6.

Figure 6:
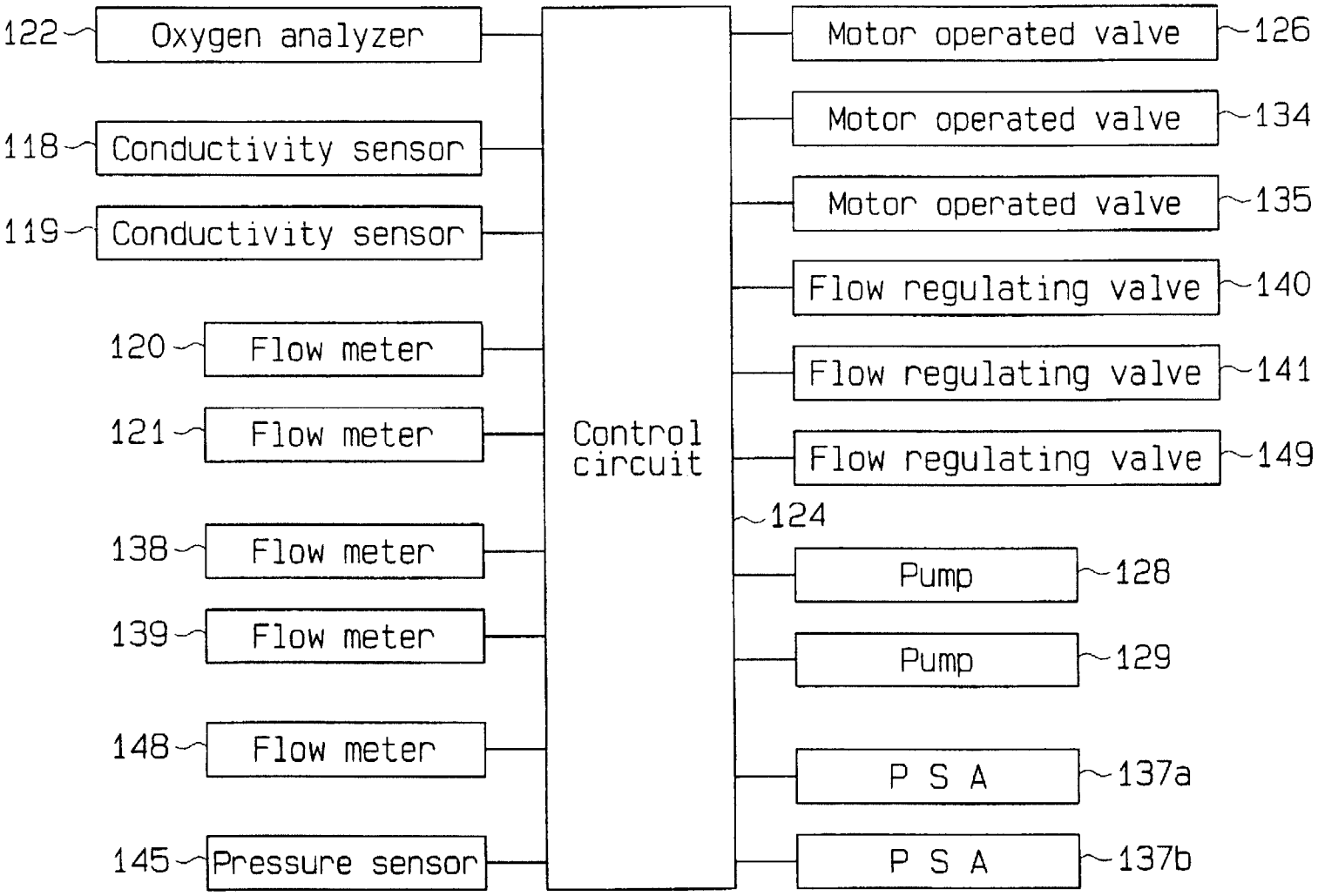
FIG. 6 is a block circuit diagram showing an electrical constitution of the protective film forming apparatus according to the fourth embodiment.

As shown in FIG. 6, the oxygen analyzer 122, conductivity sensors 118,119, flow meters 120,121,138,139,148 and pressure sensor 145 are connected to the input end of the control circuit 124. The motor operated valves 126,134,135, flow regulating valves 140,141,149, pumps 138,139 and oxygen generators 137*a*,137*b* are connected to the output end of the control circuit 124.

The control circuit 124 actuates the oxygen generator 137*a* to generate oxygen. The oxygen generated in the oxygen generator 137*a* passes through the first branch pipe 136*a* and is stored in the buffer tank 144 under compression. The pressure sensor 145 detects the internal pressure of the buffer tank 144 to send a detection signal to the control circuit 124. The control circuit 124 operates or stops the oxygen generator 137*a* based on the detection signal from the pressure sensor 145 so as to maintain the internal pressure of the buffer tank 144 within a predetermined range.

For example, when the internal pressure of the buffer tank 144 rises to 1 kgf/cm$^2$, the control circuit 124 stops the oxygen generator 137*a*. Upon the fall of the internal pressure of the buffer tank 144 to 0.5 kgf/cm$^2$, the control circuit 124 actuates the oxygen generator 137*a*. If the oxygen generator 137*a* becomes inoperable due to a breakdown or the like, the control circuit 124 actuates and controls the other oxygen generator 137*b* in place of the oxygen generator 137*a* in the same manner as described above.

The control circuit 124 allows the motor operated valves 126,134,135 to open the bypass pipes 125, and the pumps 138,139 are operated in this state. The oxygen analyzer 122, conductivity sensors 118,119 and flow meters 120,121,138, 139,148 send detection signals to the control circuit 124, respectively.

The control circuit 124 recognizes the flow rate of the condensate flowing through the water feed pipes 114,115 based on the detection signals from the flow meters 120,121 to determine the flow rate of the oxygen to be fed to the ejectors 130,131, respectively. The control circuit 124 then controls the flow regulating valves 140,141 based on the detection signals from the flow meters 138,139 to adjust the flow rate of oxygen to be supplied to the ejectors 130,131, respectively. The control circuit 124 corrects the aperture of the flow regulating valves 140,141 based on the detection signal from the oxygen analyzer 122. More specifically, the control circuit 124 controls the aperture of the flow regulating valves 140,141 so that the oxygen content of the condensate flowing through the water feed pipes 114,115 is at a level which allows formation of an iron oxide protective film on the inner wall surfaces of the pipes 114,115 (e.g., 20 to 200 ppb).

The control circuit 124 recognizes pH value of the condensate flowing through the first water feed pipe 114 based on the detection signal from the conductivity sensor 118 to determine the flow rate of the aqueous ammonia solution to be fed to the ejector 130 depending on the recognized pH value. The control circuit 124 then controls the flow regulating valve 149 based on the detection signal from the flow meter 148 to adjust the flow rate of the aqueous ammonia solution to be supplied to the ejector 130. Further, the control circuit 124 corrects the aperture of the flow regulating valve 149 based on the detection signal from the conductivity sensor 119. That is, the control circuit 124 controls the aperture of the flow regulating valve 149 such that the pH value of the condensate flowing through the water feed pipes 114,115 is at a level which allows formation of an iron oxide protective film on the inner wall surfaces of the pipes 114,115 (e.g., pH 6.5 to 9).

According to the fourth embodiment, the condensate flowing through the first water feed pipe 114 is partly diverted to the bypass pipe 125 to flow through the first and second branch pipes 125*a*,125*b*. The condensate flowing through the first branch pipe 125*a* is mixed, when it passes through the ejector 130, with the oxygen supplied from the third branch pipe 136*c* of the oxygen supply pipe 136 and the aqueous ammonia solution supplied from the ammonia supply pipe 147. Thus, ammonia-containing oxygen water is formed, and the resulting oxygen water is supplied from the outlet of the first branch pipe 125*a* into the first water feed pipe 114. As a result, the ammonia-containing oxygen water is mixed homogeneously with the condensate flowing through the first water feed pipe 114. The ammonia fed to the first water feed pipe 114 allows the condensate in the first water feed pipe 114 to assume a pH value which facilitates formation of an iron oxide protective film on the inner wall surface of the pipe 114. Accordingly, an iron oxide protective film is formed efficiently and uniformly on the inner wall surface of the first water feed pipe 114 by the oxygen dissolved in the condensate.

Meanwhile, the condensate flowing though the second branch pipe 125*b* is mixed, when it passes through the ejector 131, with the oxygen supplied from the fourth branch pipe 136*d* of the oxygen supply pipe 136. Thus, an oxygen water is formed, and it is supplied from the outlet of the second branch pipe 125*b* into the second water feed pipe 115 to be mixed homogeneously with the condensate flowing through the pipe 115. The ammonia supplied into the first water feed pipe 114 is contained homogeneously in the condensate flowing through the second water feed pipe 115. Accordingly, an iron oxide protective film is formed efficiently and uniformly on the inner wall surface of the second water feed pipe 115 by the oxygen dissolved in the condensate.

When the oxygen contained in the buffer tank 144 is supplied to the branch pipes 125*a*,125*b* of the bypass pipe 125, the internal pressure of the buffer tank 144 is lowered. When the internal pressure of the buffer tank 144 drops to 0.5 kgf/cm$^2$, the oxygen generator 137*a* is actuated, and the oxygen generated in the generator 137*a* is supplied to the buffer tank 144. When the internal pressure of the buffer tank 144 rises to 1 kgf/cm$^2$, the oxygen generator 137*a* is stopped.

If the oxygen generator 137*a* becomes inoperable due to a breakdown or the like, the other oxygen generator 137*b* is operated in place of the oxygen generator 137*a*. While it takes about 10 minutes for the oxygen generators 137*a*,137*b* after they are actuated and until they can produce oxygen stably, the oxygen remaining in the buffer tank 114 is supplied in the meantime to the branch pipes 125*a*,125*b* of the bypass pipe 125 to avoid a lapse.

According to this embodiment, the oxygen water and ammonia are not supplied separately into the condensate flowing through the water feed pipe 114, but ammonia is admixed to the oxygen water to form an ammonia-containing oxygen water beforehand, and the ammonia-containing oxygen water is supplied into the water feed pipe 114. Accordingly, the oxygen and ammonia are mixed smoothly and homogeneously with the condensate in the water feed pipe 114 immediately after the ammonia-containing oxygen water is supplied into the water feed pipe 114. The ammonia supplied into the first water feed pipe 114 is contained homogeneously in the condensate flowing through the second water feed pipe 115. Accordingly, when the oxygen water is supplied into the second water feed pipe 115, oxygen can be mixed smoothly and homogeneously with the ammonia-containing condensate in the water feed pipe 115, so that iron oxide protective films can be formed efficiently and uniformly on the inner wall surfaces of the water feed pipes 114,115.

Since the ammonia-containing oxygen water prepared beforehand is designed to be supplied into the water feed pipe 114, oxygen and ammonia can be supplied into the water feed pipe 114 using one pump 128.

According to this embodiment, oxygen and an aqueous ammonia solution can be mixed efficiently and homogeneously with the condensate under the action of the ejector 130. Accordingly, when the ammonia-containing oxygen water is supplied into the water feed pipe 114, the oxygen and ammonia is mixed more securely and homogeneously with the condensate in the water feed pipe 114.

Since the oxygen generators 137*a*,137*b* are operated and stopped repeatedly such that the internal pressure of the buffer tank 114 is within the range of 0.5 to 1 kgf/cm$^2$, the cost required for running the oxygen generators 137*a*,137*b* is minimized.

The present invention may be modified and embodied, for example, in the following manners:

(1) While a once-through boiler is depicted in which water supplied by a pump from the inlet of a pipe is evaporated during its passage through the pipe, and the steam is taken out of the outlet of the pipe in any of the foregoing embodiments, there may be employed any number of other types of boilers. For example, a natural circulation boiler utilizing the circulating force generated based on the difference between the specific gravity of the water in a downcast pipe and that of the mixture of steam and water generated in a riser pipe or a forced circulation boiler in which water is force-circulated using a pump may be used.

(2) While a high-purity oxygen is produced according to the PSA method in which oxygen is separated from other gaseous components by inducing pressure difference in any of the foregoing embodiments, oxygen may be generated by any number of other methods. For example, a high-purity oxygen gas may be produced according to the TSA (Thermal Swing Adsorption) method, in which oxygen is separated from other gaseous components by inducing temperature difference. According to this TSA method, the to-be-adsorbed gaseous components (other than oxygen) are adsorbed on zeolite at a low temperature. Subsequently, the adsorption state between zeolite and the to-be-adsorbed gaseous components is unbalanced by heating to cause temperature difference and separate the to-be-adsorbed gaseous components from zeolite. Alternatively, oxygen may be generated using an oxygen bomb. If an oxygen bomb is used, oxygen can be supplied with the aid of the internal pressure of the bomb, so that the compressor 30 for force-feeding the oxygen generated, for example, as used in the first embodiment, can be omitted.

(3) In any of the foregoing embodiments, the oxygen water may be supplied such that the oxygen content of the condensate flowing through the water feed pipes is within the range of 20 to 300 ppb, or more desirably, within the range of 80 to 200 ppb, or much more desirably, within the range of 100 to 200 ppb.

(4) While, in the first embodiment, the amount of oxygen water to be supplied to the water feed pipe 16 is adjusted by controlling the injection pump 41, flow regulating valves may be located instead on the branch pipes 40*a*,40*b* of the oxygen water supply pipe 40 to adjust the amount of oxygen water to be supplied to the water feed pipe 16 by controlling the flow regulating valves.

(5) In any of the foregoing embodiments, the oxygen water may be formed using, instead of the ejectors or the like, pumps which mix a gas with water and force-feed the resulting water.

(6) While, in the third embodiment, oxygen is designed to be supplied from one oxygen generator 94 to the first and second bypass pipes 80,81, oxygen may be supplied to the bypass pipes 80,81 from a pair of oxygen generators 94, respectively. Thus, even if trouble occurs in one of the oxygen generators 94, oxygen can be supplied to the first bypass pipe 80 or the second bypass pipe 81 from the other oxygen generator 94.

(7) In any of the foregoing embodiments, the iron oxide protective film may be formed on the inner wall surfaces of the water feed pipes utilizing an oxygen atom-containing gas such as hydrogen peroxide and ozone in place of oxygen. Otherwise, a plurality of gaseous components selected from oxygen, hydrogen peroxide, ozone, etc., may be suitably combined as the gas for forming the protective film. For example, when ozone is used in place of oxygen, the oxygen generated in the oxygen generator is converted into ozone by an ozonizer. The thus formed ozone is dissolved in the condensate, and the ozone-containing condensate is supplied into the water feed pipes. Thus, the protective film can be uniformly formed soon on the inner wall surface of the water feed pipe by the ozone having higher oxidizing power than oxygen.

(8) While an aqueous ammonia solution is used as the pH regulator in the fourth embodiment, ammonia itself may be used instead as the pH regulator. Thus, the size of the ammonia tank 149 can be reduced compared with the case where the aqueous ammonia solution is used. Further, while the aqueous ammonia solution is allowed to have an ammonia content of about 3% in the fourth embodiment, this content may be suitably changed. Moreover, as the pH regulator, other alkaline substances or acidic substances may be employed in place of the aqueous ammonia solution.

(9) While the oxygen water is formed utilizing a part of the condensate flowing through the water feed pipes in any of the foregoing embodiments, an extra water tank may be installed to form an oxygen water utilizing the water contained in the tank.

(10) While, in the fourth embodiment, the outlet of the ammonia supply pipe 147 is connected to the ejector 130, it may be connected alternatively to the first branch pipe 125*a* on the upstream side of the pump 128. Thus, a negative pressure can be induced also at the outlet of the ammonia supply pipe 147 under operation of the pump 128. Accordingly, the aqueous ammonia solution in the ammonia supply pipe 147 is sucked into the first branch pipe 125*a* to be mixed with the condensate in the pipe 125*a*.

What is claimed is:

1. An apparatus including a boiler for receiving water from a water feed pipe and heating the water into steam and a condenser for condensing, said steam into condensate, wherein said condensate is fed back to the boiler through the water feed pipe, said apparatus comprising:

a solute source including a solute selected from a group consisting of oxygen, hydrogen peroxide and ozone;

means for generating an aqueous solution by dissolving the solute supplied from the solute source into water;

means for supplying the aqueous solution to the water feed pipe to form a protective film made of iron oxide on an inner surface of the water feed pipe;

wherein said supplying means includes a bypass pipe for receiving the condensate from the water feed pipe and feeding the condensate to the water feed pipe, and wherein said generating means includes means for introducing the solute into the bypass pipe to mix the solute with the condensate; and wherein said introducing means includes a solute feed pipe connected to the bypass pipe to supply the solute to the bypass pipe, and second generating means for generating negative pressure at a junction of the bypass pipe and the solute feed pipe to draw the solute to the bypass pipe from the solute feed pipe.

2. The apparatus as set forth in claim 1 further comprising:

deaerating means disposed in the water feed pipe to remove gas contained in the condensate passing in the water feed pipe; and said supplying means being arranged to supply the aqueous solution downstream the deaerating means to the water feed pipe.

3. An apparatus including a boiler for receiving water from a water feed pipe and heating the water into steam and a condenser for condensing said steam into condensate, wherein said condensate is fed back to the boiler through the water feed pipe, said apparatus comprising:

a solute source including a solute selected from a group consisting of oxygen, hydrogen peroxide and ozone;

means for generating an aqueous solution by dissolving the solute supplied from the solute source into water;

means for supplying the aqueous solution to the water feed pipe to form a protective film made of iron oxide on an inner surface of the water feed pipe;

wherein said supplying means includes a bypass pipe for receiving the condensate from the water feed pipe and feeding the condensate to the water feed pipe, and wherein said generating means includes means for introducing the solute into the bypass pipe to mix the solute with the condensate;

wherein said introducing means includes a solute feed pipe connected to the bypass pipe to supply the solute to the bypass pipe, and second generating means for generating negative pressure at a junction of the bypass pipe and the solute feed pipe to draw the solute to the bypass pipe from the solute feed pipe; and wherein said bypass pipe has an inlet and an outlet, said inlet and said outlet both being connected to the water feed pipe and disposed adjacent to one another.

4. The apparatus as set forth in claim 3, wherein said supplying means includes a pump disposed in the bypass pipe to feed the condensate to the outlet from the inlet.

5. The apparatus as set forth in claim 3 further comprising:

a deaerator disposed in the water feed pipe to remove gas contained in the condensate passing in the water feed pipe; and said bypass, pipe including a first pipe and a second pipe, said first pipe being connected to the water feed pipe between the condenser and the deaerator, said second pipe being connected to the water feed pipe between the deaerator and the boiler.

6. An apparatus including a boiler for receiving water from a water feed pipe and heating the water into steam and a condenser for condensing said steam into condensate, wherein said condensate is fed back to the boiler through the water feed pipe, said apparatus comprising:

a solute source including a solute selected from a group consisting of oxygen, hydrogen peroxide and ozone;

means for generating an aqueous solution by dissolving the solute supplied from the solute source into water;

means for supplying the aqueous solution to the water feed pipe to form a protective film made of iron oxide on an inner surface of the water feed pipe;

wherein said supplying means includes a bypass pipe for receiving the condensate from the water feed pipe and feeding the condensate to the water feed pipe, and wherein said generating means includes means for introducing the solute into the bypass pipe to mix the solute with the condensate;

wherein said introducing means includes a solute feed pipe connected to the bypass pipe to supply the solute to the bypass pipe, and second generating means for generating negative pressure at a junction of the bypass pipe and the solute feed pipe to draw the solute to the bypass pipe from the solute feed pipe;

a reservoir for reserving a pH regulator, the pH regulator being mixed in the bypass pipe with the condensate to regulate pH value of the condensate passing in the water feed pipe; and means for feeding pH regulator from the reservoir to the first supply pipe.

7. The apparatus as set forth in claim 6, wherein said feeding means includes:

a supply pipe connected to the bypass pipe to supply the pH regulator to the bypass pipe; and third generating means for generating negative pressure at a junction of the bypass pipe and the supply pipe to draw the pH regulator to the bypass pipe from the supply pipe.

8. The apparatus as set forth in claim 7, wherein said second generating means is at least partially defined by said third generating means.

9. An apparatus including a boiler for receiving water from a water feed pipe and heating the water into steam and a condenser for condensing said steam into condensate, wherein said condensate is fed back to the boiler through the water feed pipe, and wherein oxygen is supplied to the water feed pipe to form a protective film made of iron oxide on an inner surface of the water feed pipe, said apparatus comprising:

a bypass pipe for receiving the condensate from the water feed pipe and feeding the condensate to the water feed pipe;

an oxygen source;

means for introducing the oxygen into the bypass pipe from the oxygen source to mix the oxygen with the condensate, wherein oxygen water is generated by dissolving the oxygen into the condensate;

wherein said introducing means includes an oxygen feed pipe connected to the bypass pipe to supply the oxygen to the bypass pipe, and means for generating negative pressure at a junction of the bypass pipe and the oxygen feed pipe to draw the oxygen to the bypass pipe from the oxygen feed pipe.

10. The apparatus as set forth in claim 9, wherein said oxygen source includes an oxygen generator for producing the oxygen based on one of the pressure swing adsorption method and the thermal swing adsorption method.

11. The apparatus as set forth in claim 10 further comprising:

said bypass pipe having an inlet and an outlet, said inlet and said outlet both being connected to the water feed pipe and disposed adjacent to one another; and a pump disposed in the bypass pipe to feed the condensate to the outlet from the inlet.

* * * * *

UNITED STATES PATENT AND TRADEMARK OFFICE

CERTIFICATE OF CORRECTION

PATENT NO.: 5,797,357
DATED: August 25, 1998
INVENTOR(S): ATSUSHI KAWACHI ET AL.

It is certified that an error appears in the above-identified patent and that said Letters Patent is hereby corrected as shown below:

On the title page: Item [30] Foreign Application Priority Data, please replace "7-144787" with --7-114787--;

Signed and Sealed this

Fifth Day of January, 1999

*Attest:*

*Attesting Officer*

*Acting Commissioner of Patents and Trademarks*